US005746184A

United States Patent [19]

Ekstam

[11] Patent Number: 5,746,184

[45] **Date of Patent: *May 5, 1998**

[54] FUEL DELIVERY SYSTEM FOR DIESEL ENGINES

[75] Inventor: Charles L. Ekstam, Champaign, Ill.

[73] Assignee: Ekstam Patent, L.L.C., Jefferson City, Mo.

[ * ] Notice: The term of this patent shall not extend beyond the expiration date of Pat. No. 5,355,860.

[21] Appl. No.: 261,469

[22] Filed: Jun. 17, 1994

Related U.S. Application Data

[63] Continuation-in-part of Ser. No. 911,119, Jul. 9, 1992.

[51] Int. Cl.[6] ..... F02M 37/04

[52] U.S. Cl. ..... 123/510; 123/516; 137/192

[58] Field of Search ..... 123/510, 516, 123/509, 518; 317/192, 193, 194, 195, 196

[56] References Cited

U.S. PATENT DOCUMENTS

| | | | |
|---|---|---|---|
| 1,269,787 | 6/1918 | Church . | |
| 2,222,274 | 11/1940 | Antonsen | 123/139 |
| 2,642,148 | 6/1953 | Grisé | 183/2.5 |
| 4,372,847 | 2/1983 | Lewis | 210/86 |
| 4,411,239 | 10/1983 | Kelch | 123/557 |
| 4,416,108 | 11/1983 | Ghandhi | 123/516 |
| 4,454,848 | 6/1984 | Duprez | 123/516 |
| 4,539,965 | 9/1985 | Soltau | 123/514 |
| 4,763,684 | 8/1988 | Kelch | 137/196 |
| 4,933,093 | 6/1990 | Keller | 210/774 |
| 4,979,482 | 12/1990 | Bartlett | 123/510 |
| 5,103,793 | 4/1992 | Riese | 123/510 |
| 5,203,306 | 4/1993 | Billingsley | 123/516 |
| 5,231,967 | 8/1993 | Baltz | 123/516 |
| 5,287,841 | 2/1994 | Forsythe | 123/510 |
| 5,339,787 | 8/1994 | Jungquist | 123/516 |
| 5,355,860 | 10/1994 | Ekstam | 123/510 |
| 5,389,245 | 2/1995 | Jaeger | 123/516 |

*Primary Examiner*—Carl S. Miller
*Attorney, Agent, or Firm*—Duft, Graziano & Forest, P.C.

[57] ABSTRACT

A fuel delivery system (200) is provided for removing air from fuel delivered to a diesel engine, and includes a primary water separation filter (16), and a secondary air separation filter (18). The air separation filter (18) is located downstream from the water separation filter (16) for delivering substantially gas-free fuel to the engine at a positive pressure in a volumetric rate exceeding engine fuel demand. The air separation filter includes a vessel (58), a fuel inlet into the vessel (300), a fuel outlet (424) leading to the engine, an inlet side fuel return discharge (294), an outlet side fuel return discharge (428) leading to the fuel tank, and a filter cartridge (58) including filter element (94) presenting numerous small openings therein for permitting the passage of fuel therethrough but screening out bubbles entrapped in the fuel. As the bubbles are trapped on the element, they float upwardly for discharge through gas discharge port (294). Bubbles passing through element 94 are swept upwardly for discharge through the outlet side discharge port (428) to ensure a substantially gas and vapor-free supply of fuel to the engine.

20 Claims, 8 Drawing Sheets

FUEL DELIVERY SYSTEM FOR DIESEL ENGINES

RELATED APPLICATIONS

This Application is a continuation-in-part of application Ser. No. 07/911,119, filed Jul. 9, 1992.

BACKGROUND OF THE INVENTION

1. Field of the Invention

A novel fuel delivery system for removing entrained air from a source of fuel is provided. The system advantageously includes not only a water separator, but also a separation chamber including filter media for removing air from the fuel. The air separation chamber may be replaced with a plate having gas discharge ports on both the fluid inlet and outlet sides of the filter media.

2. Description of the Prior Art

Internal combustion engines are designed and configured to operate on fuel of a standard quality, and the introduction of impurities into the fuel may impair or prevent operation of the engine. For example, it is well known that even a small quantity of water in diesel fuel may prevent operation of a diesel engine. As a result, most diesel engines in motor vehicles include, in addition to a filter for removing sediment or other solids in the fuel, a water separator for removing water which has condensed in the fuel line or fuel tank, or was introduced into the fuel tank in a liquid state.

Many diesel engines used in over-the-road trucking consume prodigious amounts of fuel. For example, a six cylinder diesel engine operating at full power may utilize 22 to 25 gallons per hour. Fuel is delivered to the cylinder for combustion with the air in precise amounts by fuel injectors. Since the amount of air in the cylinder in a diesel engine is known (determined by the volume of the cylinder), the fuel/air mixture is normally tightly controlled, often by electronic fuel injection which may even compensate for temperature and other variables in the air supply. Unfortunately, when air has been entrained in the diesel fuel and delivered to the fuel injection system, it has been found that engine performance suffers. The greater the amount of air in the diesel fuel, the more deleterious the effect. Thus, there has developed a need for a fuel delivery system which can remove entrained air and other gases and vapors from the fuel delivered to the engine.

Newer diesel engines, such as the Series 50 and 60 DDEC engines from Detroit Diesel of Detroit, Mich. and the 3406E or 3176 engines from Caterpillar of Peoria, Ill., utilize 70–95 gallons per hour of diesel fuel for cooling the electronically controlled injectors and supplying diesel to the engine for consumption.

The electronically controlled injection engines require a high volume of fuel to cool the injectors and meet engine demand. These high recirculation volumes and/or increased pressures can greatly exacerbate the problems induced by entrained air in the fuel.

SUMMARY OF THE INVENTION

The problems that are outlined above have largely been solved by the fuel delivery system of the present invention, which includes a ported air separation system that is capable of supplying a pressurized recirculatory flow at a rate exceeding engine fuel demand. Fuel exiting the delivery system is pressurized to prevent the reformation of gasses in the gas-free fuel as it travels to the engine.

In greater detail, a first embodiment the present invention includes a tertiary filter which removes residual air bubbles entrapped and entrained in the fuel which would otherwise be delivered to the fuel injection system of the engine. The fuel is preferably delivered from the fuel tank through a water separation filter and then through a pump to a particulate filter which removes any remaining soil, rust particles or the like. The fuel then passes through a regulator before passing to the air removal filter.

The air removal filter includes a vessel defining an interior which acts as a reservoir for fuel. A separation or filter media is located within the reservoir so as to be submerged within the fuel. The vessel also includes an inlet for receiving fuel into the reservoir, an outlet leading to the fuel injector pump and cylinders of the engine, and an overflow tube which leads to a fuel return line for returning fuel and air bubbles back to the fuel tank.

In preferred forms, the filter media is provided as an elongated tube which is threadably mounted on a housing portion of the vessel, with the lower or canister portion of the filter being threadably mounted to the housing. Thus, when and if the filter media needs to be replaced, the canister can be disconnected and only the filter media need be replaced. The canister is advantageously provided with a fuel drain at the bottom thereof for permitting controlled discharge of the fuel received therewithin. Additionally, an air purge line may connect the outlet with the uppermost portion of the vessel whereby air within the outlet can be purged back to the fuel tank during filling of the reservoir and outlet.

The system also includes a pump for ensuring adequate fuel flow through the filter media, and a regulator for limiting fuel flow according to pressure downstream therefrom to prevent damage to the system.

In a second embodiment of the invention, which may be used in both pressurized and non-pressurized fuel systems, the filtration assembly includes filtration canister having a chamber divided into an inlet side and an outlet side by a filtration element. A filtration canister mounting body has an inlet side air removal port communicating the chamber inlet side with a return line to the fuel tank, and an outlet side air removal port communicating the chamber outlet side with the tank return line. The filter mounting body is operably coupled with the filtration unit to cause portions of the fluid to pass through the element from the inlet side to the outlet side of the filtration element. A pump may be provided for receiving the fuel at a first pressure and discharging the fuel at a second pressure greater than the first pressure. The filtration canister is preferably configured to receive fuel from the pump.

In the operation of the pressurized embodiment, the fuel containing trapped or entrained gas bubbles receives a pressure boost from the pump and then enters the filtration unit for gas removal. Some of the bubbles immediately float to the surface, while others float to the surface after the filter element dislodges them from the surrounding liquid. At the surface, these bubbles enter the first gas exit port, and are carried with the excess fuel through the return line. The increased pressure may serve to compress other entrained bubbles to dimensions sufficient to pass through the filter pores, and so these bubbles are flashed through with the liquid to the outlet side of the element. The flashed bubbles tend to rise to the surface towards the second gas exit port where they also exit the mounting body. Examples of this embodiment have been field-tested to yield increased fuel economies of from about 6% to about 15%.

DESCRIPTION OF THE PREFERRED EMBODIMENTS

Figure 1:
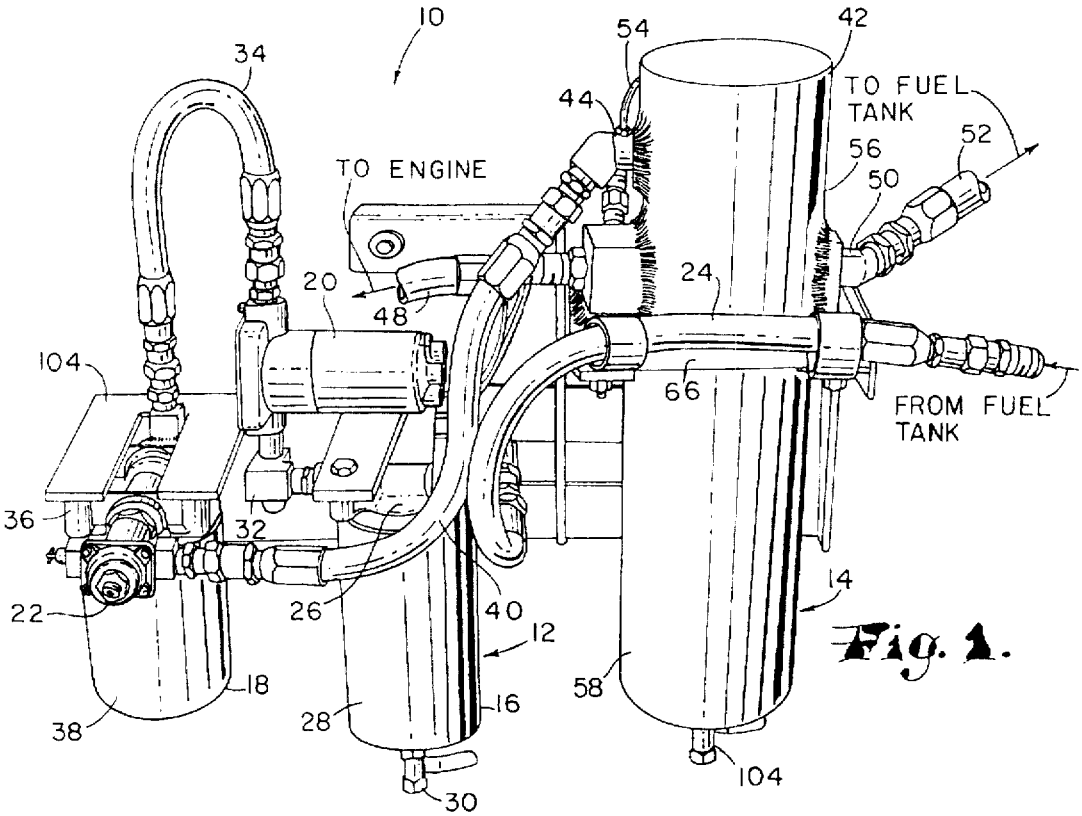
FIG. 1 is a top front perspective view of a first embodiment of the fuel delivery system for internal combustion engines in accordance with the present invention, showing the water separation filter, the particulate filter, the air filter, the fuel pump, and the regulator.

Referring now to the drawings, a fuel delivery system 10 in accordance with a first embodiment of the present invention includes initial fuel filter means 12 and a secondary fuel filter 14 for removing an undesired gas such as air bubbles entrained within the fuel moving therethrough. As described further herein, the system 10 is described as used with a diesel engine as is used in semi-trailer tractors, but it is to be understood that the invention is equally applicable to all internal combustion engines whose performance may be enhanced by the provision of fuel free from air or other unwanted gasses. The initial fuel filter means may include a water separation filter 16 and a particle filter 18, as well as a fuel pump 20 and a regulator valve 22.

Figure 2:
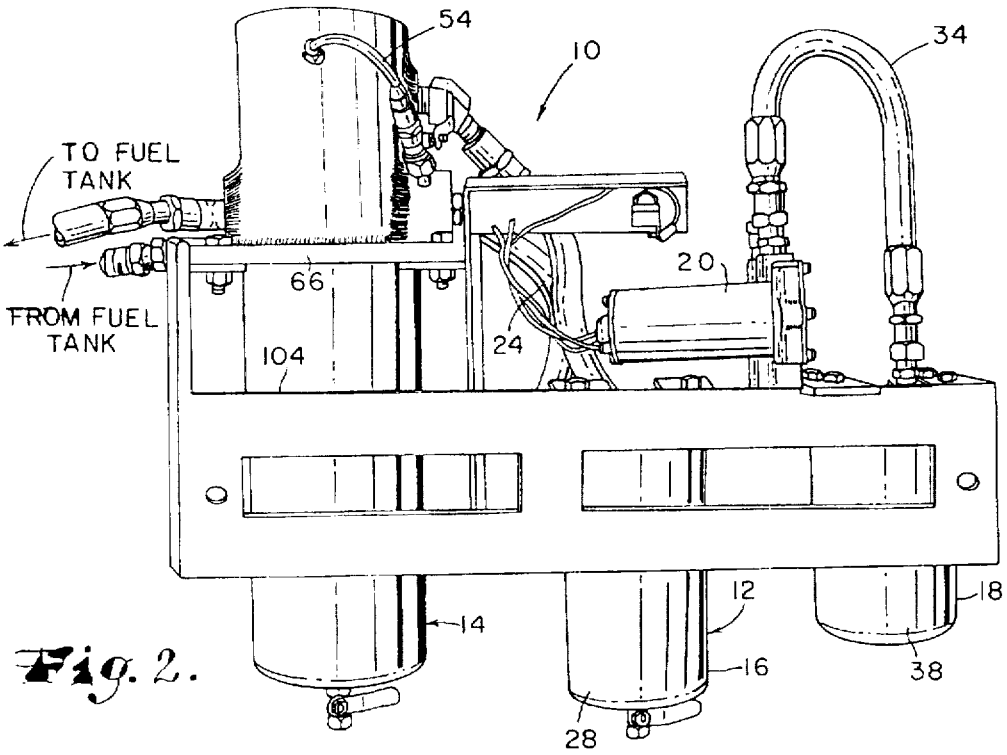
FIG. 2 is a top rear perspective view of the fuel delivery system shown in FIG. 1.

In greater detail, FIGS. 1 and 2 illustrate the preferred embodiment of the invention for use with a diesel engine, wherein a braided steel intake conduit 24 connects the water separation filter 16 with a source of fuel, e.g. a fuel tank. Intake conduit 24 thus leads to the water separation filter 16 where water in liquid form is removed from the fuel as is conventional in diesel engine applications and well known to those skilled in the art. The water separation filter 16 as shown herein includes a filterhead 26 and a removable cartridge 28 provided with a drain valve 30 for removing collected water therewithin. The cartridge as shown has been fabricated using a screen within a cartridge, but such water separators are well known in the art. A water separator of this type may be obtained from Engine Research, Inc. of Bement, Ill., as model number 70804.

Fuel is then conveyed via transfer fitting 32 to fuel pump 20, which is a standard electric fuel pump sold as a unit with the regulator valve 22 as part number 12802 manufactured by Holley company of Goodletsville, Tenn. It is to be understood that the various fittings and fuel lines are provided with suitable threaded collars and the like to permit fluid-tight connections as is conventional and well known in the art. Fuel is thus pressurized by the pump 20 and transferred to the particle filter 18 by braided steel pump discharge line 34. Particle filter 18 includes a filterhead 36 available from Fleetguard as part number 142784 and a filter element 38 threadably mounted thereon. One such filter element is sold under the part number FF211 and is available from Fleetguard of Nashville, Tenn. The particle filter 18 serves to remove unwanted solids carried with the fuel. Such solids could be rust particles from the fuel tank, or any other solid debris carried with the fuel.

From the particle filter 18, fuel passes through regulator 22 for controlling the flow rate at which the fuel is delivered. In the present embodiment for use with a six cylinder Cummins "NTC" series engine, the regulator would be set to 35 gph for fuel passing from the regulator 22 through braided steel inlet line 40.

Figure 3:
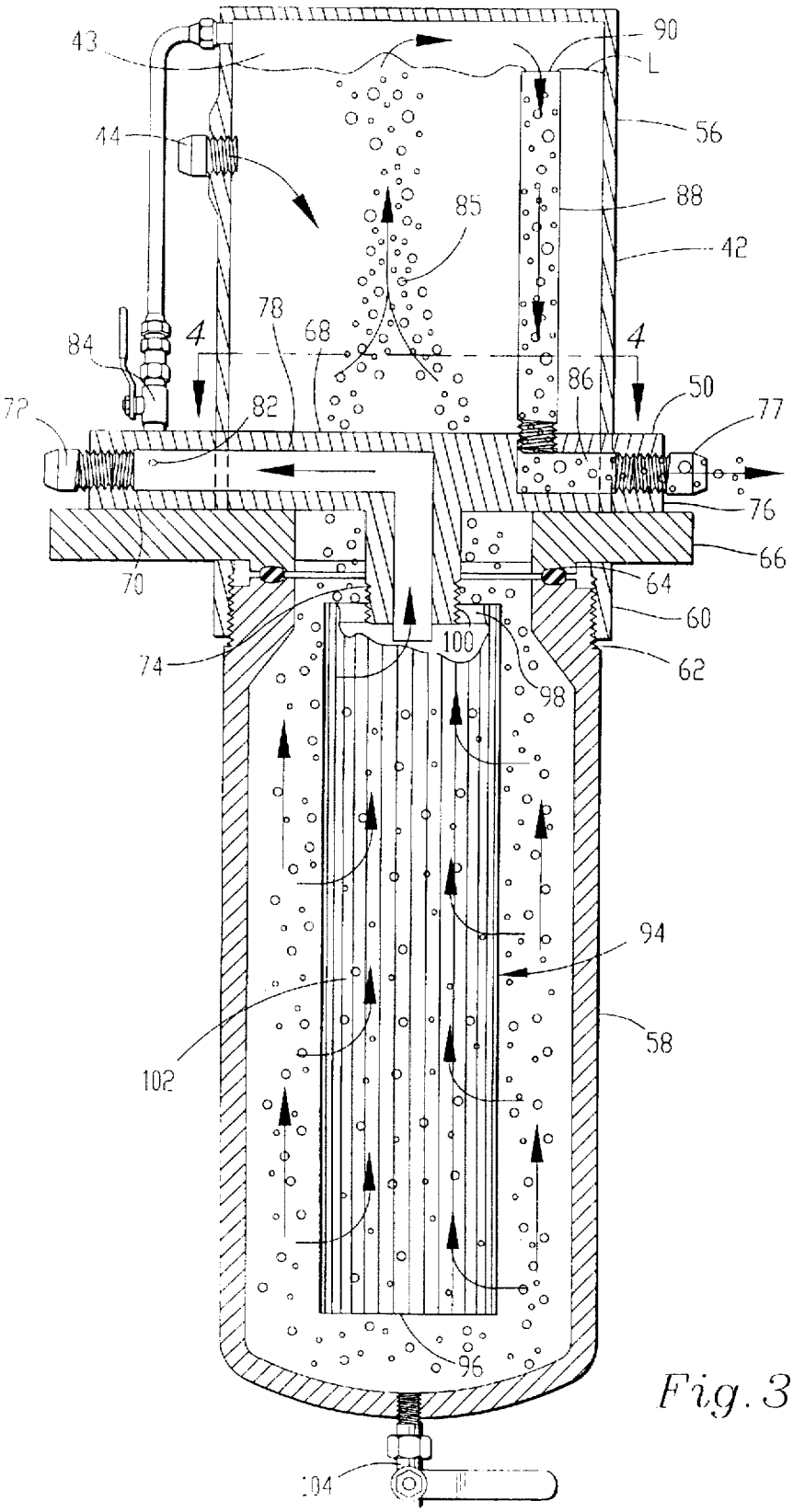
FIG. 3 is an enlarged, vertical cross-sectional view of the air filter showing the path of the fuel and the separation of the bubbles of air therefrom.
Figure 5:
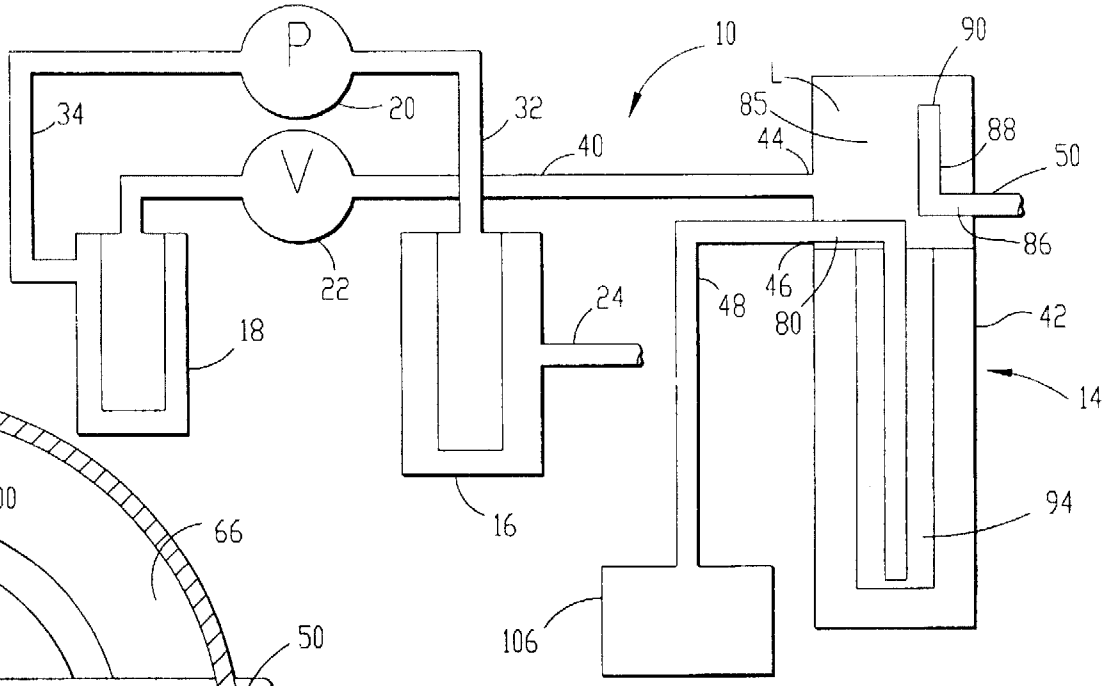
FIG. 5 is a schematic view representing the flow of fuel and air through the fuel delivery system hereof.
Figure 4:
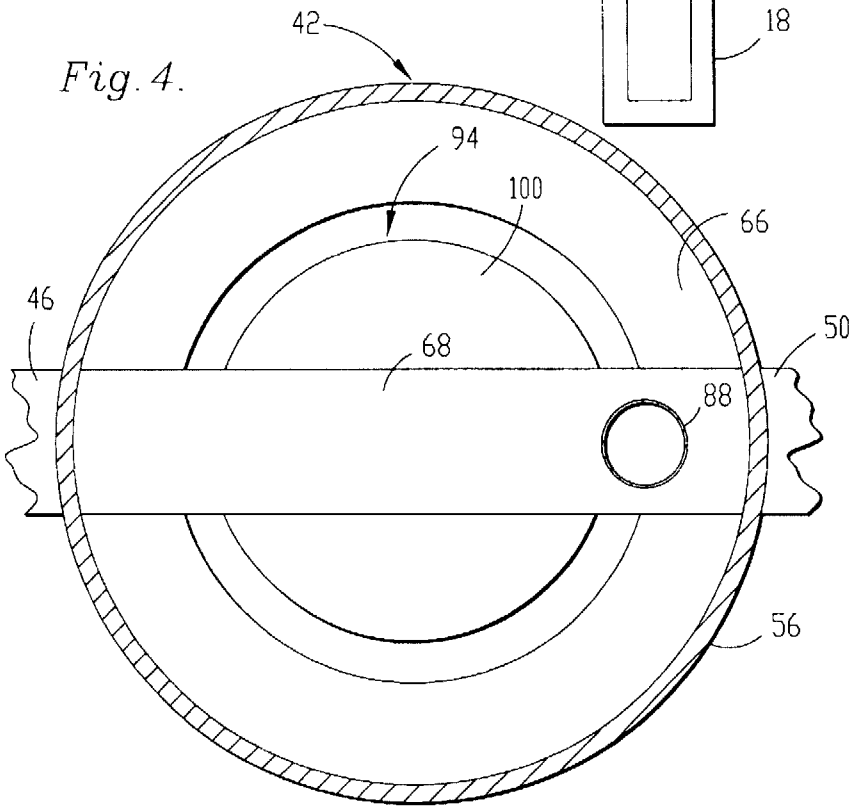
FIG. 4 is an enlarged, horizontal cross-sectional view of the air filter taken along line 4—4 of FIG. 3.

Secondary fuel filter 14 for removing air from the fuel is shown in greater detail in FIGS. 3 and 4 and includes a vessel 42 defining an interior 43, an inlet 44 fluidically connected to inlet line 40, an outlet 46 fluidically connected to a fuel outlet line 48 leading to the fuel injection system and engine, and a fuel return discharge 50 which is connected to fuel return line 52 leading to the fuel tank supplying fuel to the engine. The secondary fuel filter also includes an air purge line 54 connecting the outlet 46 and the uppermost portion of the vessel 42 to allow air to bleed out of the outlet 46 and the fuel outlet line 48 during initial filling of the vessel with fuel.

Vessel 42 includes an uppermost housing portion 56 and a lowermost canister portion 58 threadably connected thereto. The housing 56 presents a lower circumscribing lip 60 which is internally threaded and complimentarily configured with an upper rim 62 of canister 58 which is externally threaded. An O-ring seal 64 is provided between mounting bracket 66, which is welded around its circumference to housing 56, and canister 58.

Outlet 46 and fuel return discharge 50 are formed of a single block 68 of aluminum, steel, brass or other metal which can be readily worked. Block 68 includes an outlet leg 70 threadably receiving outlet fitting 72 thereon, a substantially centrally located filter media receiver 74, and a fuel return leg 76 which is threaded to receive return fitting 78 thereon. Block 68 defines an L-shaped passageway 80 therein extending from downwardly extending externally threaded filter receiver 74 through outlet leg 70. Adjacent the portion of outlet leg 70 receiving fitting, an aperture 82 is provided through the block 68 for fluidically connecting the passageway 80 and the fuel outlet line 48 to the air purge line 54. The air purge line 54 includes a valve 84 which is normally closed during operation but may be opened during filling of the vessel and fuel outlet line 48 to permit air which would otherwise be trapped therein to flow back to the upper portion of the housing. The air purge line 54 is preferably connected to the housing 56 at a point above the normal fuel level L within the vessel so that air flowing through the air purge line 54 may avoid the creation of any unnecessary air bubbles 85.

Fuel return leg 76 in block 68 is also provided with an L-shaped bore 86 receiving thereon overflow tube 88. The upper margin 90 of overflow tube 92 defines the fuel level L, and serves to provide somewhat of a fluid head to aid in ensuring positive fuel flow through the passageway 80 to the fuel outlet line.

The filter receiver 74 is externally threaded as noted above and receives thereon replaceable filter cartridge 94 for filtering air from fuel, cartridge 94 being preferably an elongated tubular, cylindrical shaped member having an enclosed bottom 96, a top 98 which is impermeable and provided with a threaded opening 100, and a circumscribing filter media 102 which is preferably permeable paper having openings no greater than 25 microns and most preferably 20 microns or less. The filter media 102 is submerged below the fuel level L as determined by the upper margin 90 of the overflow tube 88 to provide the following advantages: (1) a sufficient supply of fuel is provided on demand to the engine; (2) air bubbles retained on the filter media 102 are allowed to float up and away from the filter media; (3) a sufficient amount of liquid is provided above the filter media 102 so that many bubbles float up to fuel level L and out of overflow tube 92 before coming in contact with the filter media 102; and (4) only fuel and not free (non-bubble) air comes in contact with the filter media to prevent air from moving downstream through the outlet. A drain tap 104 is provided at the bottom of the canister 58 for ease in draining the vessel 42 during change-out of the air filter cartridge 94.

The essential components of the fuel delivery system 10 hereof are mounted on a bracket 104, and while the specific arrangement of the components is not critical, it is important that the outlet 46 be somewhat elevated relative to the fuel injector delivery system so that outlet line 48 inclines downwardly from the outlet 46. This enables the fuel in the vessel 42, and particularly that in the housing 56, to maintain a fluidic head to ensure constant delivery of fuel to the fuel injectors and engine 106, and also allows any air in the outlet line 48 to bleed out through air purge line 54 during filling. Thus, prior to normal operation of the engine, fuel is pumped by the fuel pump 20 until the vessel 42 is filled to the fuel line L. During filling, the valve 84 is open to permit the purged air to return to the fuel tank through the overflow tube 88 until fuel begins to flow back to the tank through return line 52, which indicates that the system 10 is fully charged for operation.

In some circumstances, it may be desirable to cycle fuel through the system 10 prior to engine operation so that the fuel may be prefiltered. The fuel delivery system 10 permits the user to have that option which may be especially desired when fuel has been sitting unused for an extended period. It may then be desirable to filter microbes which develop under those circumstances by prefiltering the fuel and, if necessary, changing the filter element(s) before use.

In operation, the present system ensures a positive delivery of fuel to the fuel injection pump which is substantially free of unwanted gasses such as air. It should be recognized that the pump 20 ensures a positive fuel flow through both the primary and secondary filters, and that the possibility of fuel starvation to the engine is accordingly lessened by the provision of pump 20. In addition, diesel and other distillate fuels are especially susceptible to retaining air bubbles. Thus, even though the fuel may settle in a fuel tank and then pass through water separation filter 16 and the particle filter 18, significant quantities of air bubbles remain entrained in the fuel.

Fuel thus enters air separation filter 14 from the inlet line 40 and through inlet 46 into the vessel 42. The inlet 46 is preferably below fuel level L. The fuel is drawn downwardly and the circulation within the vessel 42 may cause some of the bubbles 85 to float free to level L. Some of the bubbles 85 are carried downwardly toward filter cartridge 94. The filter media 102 of the cartridge, having only very small openings of 25 microns or less, and most preferably 20 microns or less, allows the liquid fuel to pass through but the air bubbles are trapped on the filter media 102 and cannot pass through the filter media to enter the interior of the filter cartridge 94. The bubbles 85 dislodge from the filter media and float to the surface either through agitation or as the size of the bubbles 85 increase due to aggregation when the buoyancy of the air is greater than the adhesion between the surface of the bubble 85 and the filter media.

As the bubbles float to the surface or level L, they spill over margin 90 and are carried with the excess fuel to move downwardly through the upright overflow tube 88. The pump 20 and regulator 22 permit sufficient flow of fuel into the vessel 42 so that even during full throttle application of the engine, there will be excess fuel or "positive flow" flowing back to the tank through the return line 52. This ensures both an absence of fuel starvation as well as a continuous removal of unwanted air from the fuel being delivered to the engine.

Figure 6:
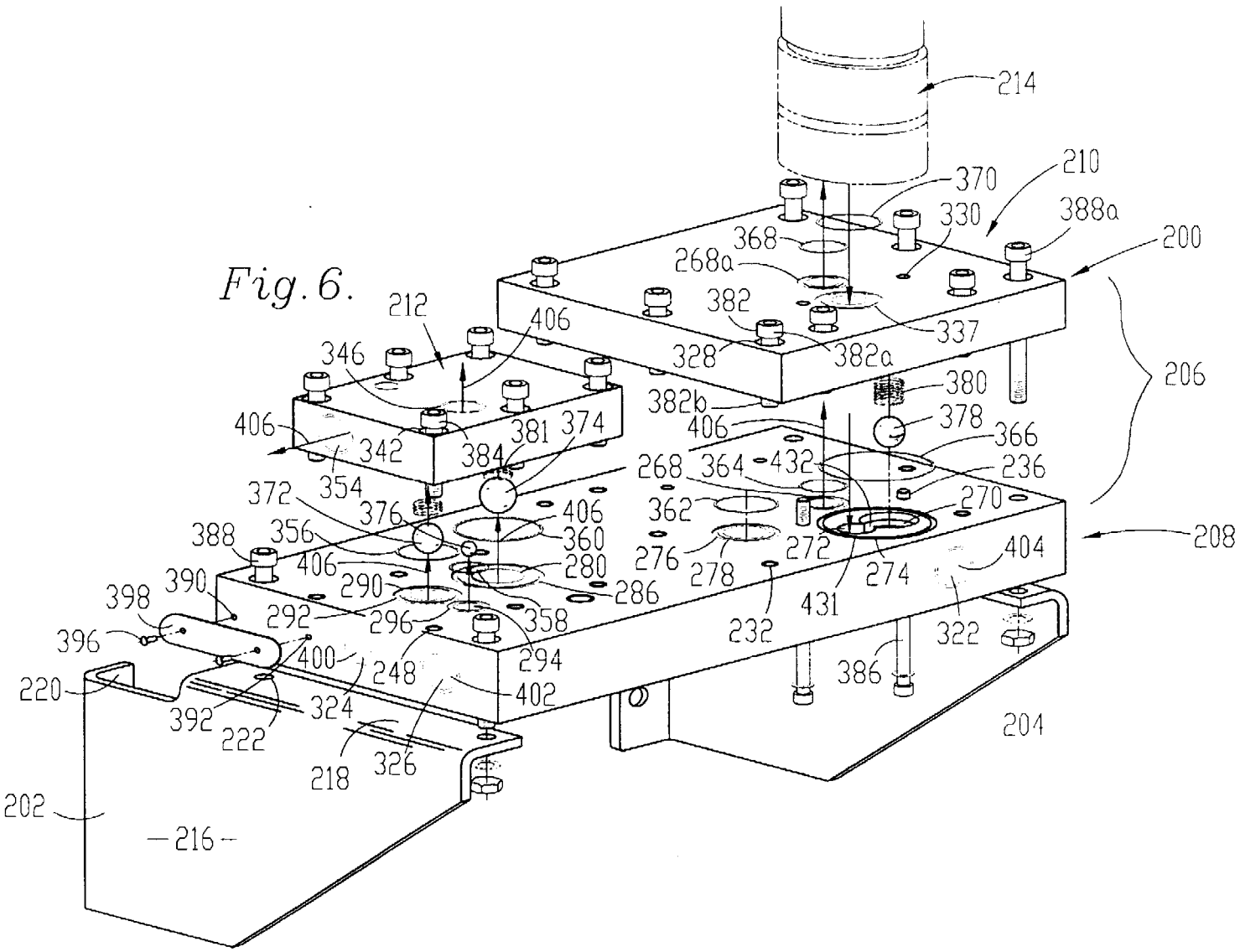
FIG. 6 is a front, top, right side perspective assembly view of a second embodiment including a pressurized filter mounting body having a plurality of plates.

Turning now to a second embodiment of the invention which is depicted in FIGS. 6–21, with emphasis upon FIG. 6, filter assembly 200 has opposed mounting wings 202 and 204; a main filter mounting body 206 manufactured from aluminum in three plate sections including an apertured main plate 208, a water separator area plate 210 adapted to overlay a portion of plate 208, and an air separator area plate 212; and electric fuel pump 214.

Opposed wings 202 and 204 are depicted as presenting mirror images with respect to one another, but any suitable geometry may suffice for connecting plate 208 with a truck firewall (not depicted), frame, or other like structure. Wing 202 has an intermediate section 216 forming a bevelled vertical plane joining a horizontally extending and normally oriented upper shelf 218 with a rearward shelf 220. Shelves 218 and 220 have a number of shelf bolt-receiving apertures, e.g., aperture 222, for coupling with plate 208.

Figure 12:
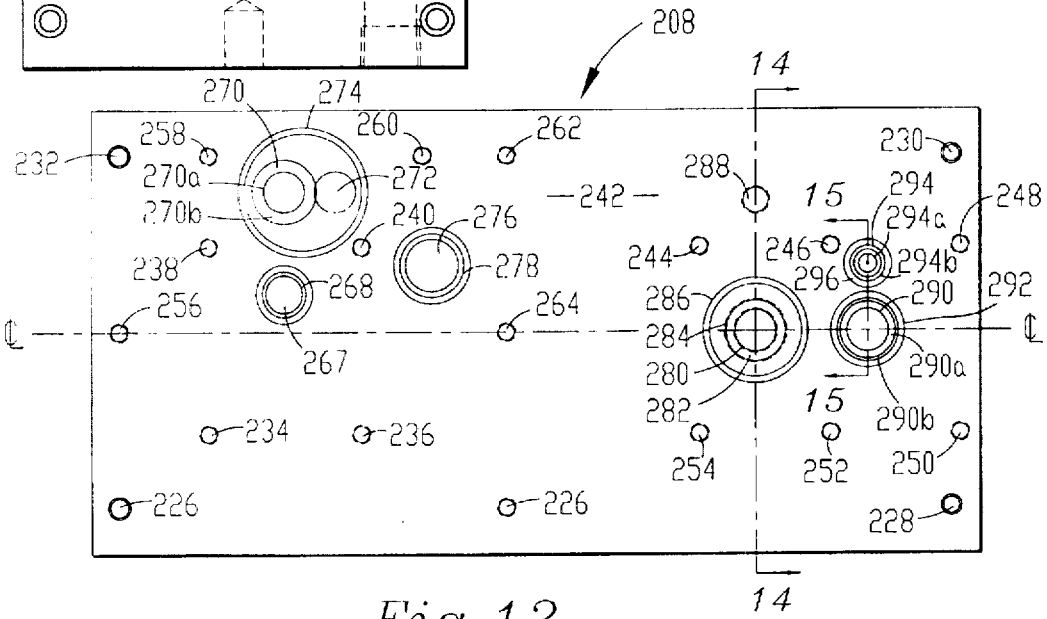
FIG. 12 is a top plan view similar to that of FIG. 9, except the hidden lines depicting interior flow passageways and other structure have been removed.
Figure 11:
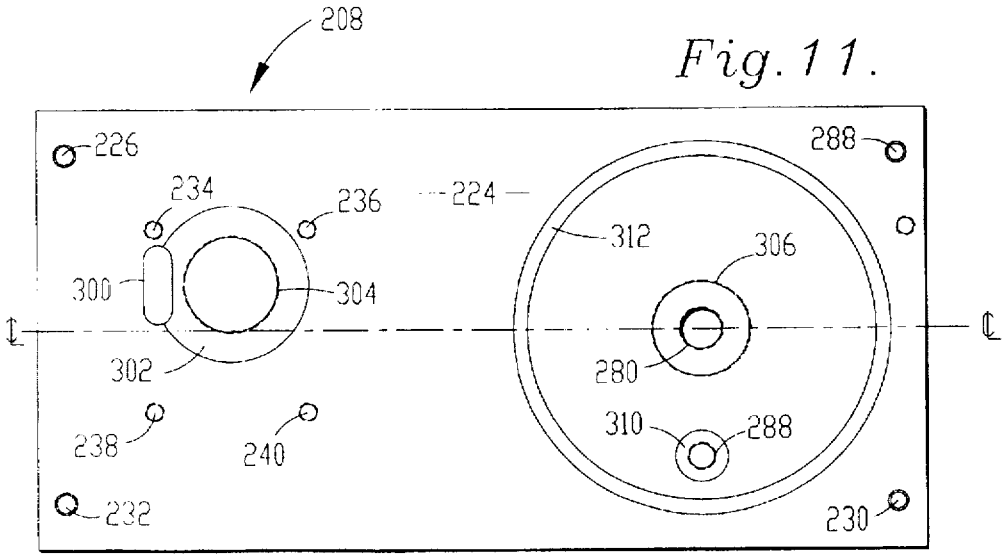
FIG. 11 is a bottom plan view of the main plate depicted in FIG. 9.
Figure 19:
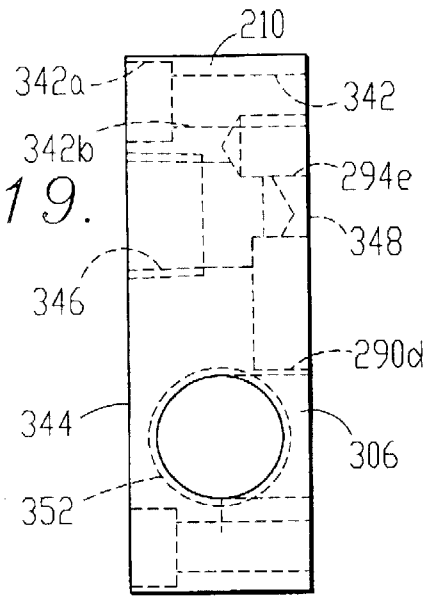
FIG. 19 is a right side view of the plate in FIG. 18.
Figure 21:
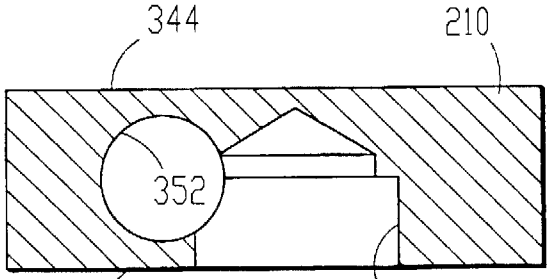
FIG. 21 is a side sectional view taken along line of 21'—21' of FIG. 18.
Figure 18:
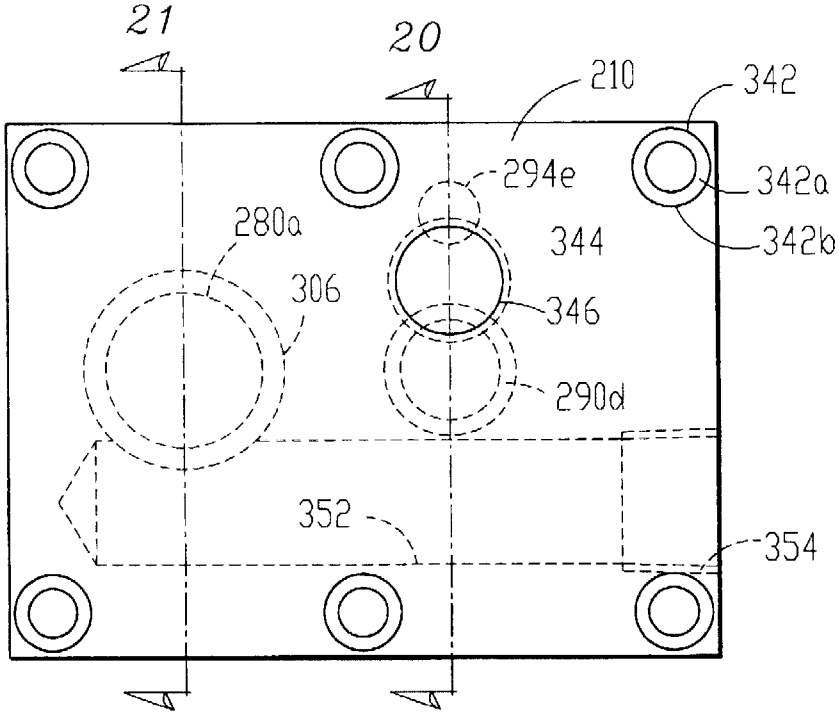
FIG. 18 is a top plan view of a third plate of the invention.
Figure 20:
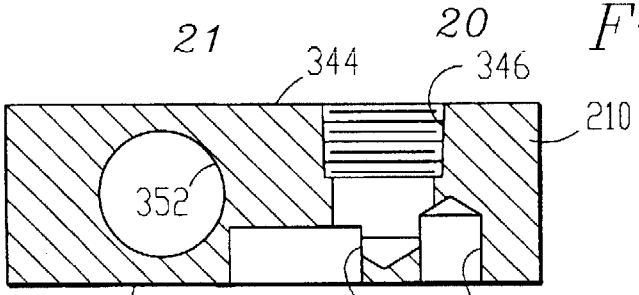
FIG. 20 is a side sectional view taken along side of 20'—20' of FIG. 18.

FIGS. 11 and 12 depict main plate 208 from top and bottom perspectives. Bottom main plate face 224 defines apertures 226, 228, 230 and 232 for receiving threaded members (not depicted in FIGS. 11 and 12) that couple plate 208 with respective wings 202 and 204, e.g., by aligning aperture 222 with aperture 228. Additionally, plate 208 incorporates a plurality of threaded apertures 234, 236, 238, and 240 extending through the plate for receiving threaded members (not depicted in FIGS. 11 and 12) that couple plate 208 with pump 214.

Main plate top surface 242 (FIG. 12) includes identical threaded cylindrical cavities 244, 246, 248, 250, 252, and 254, for receiving threaded members (not depicted in FIGS. 11 and 12) for coupling plate 208 with plate 212. Threaded cavities 256, 258, 260, 262, 264, and 266, which receive threaded members (not depicted in FIGS. 11 and 12) for coupling plate 208 with plate 210, are each identical to cavities 244–254.

Plate 208 also incorporates fuel pump inlet bore 267 having an annular O-ring seating groove 268, pump bypass bore 270 having a lower narrow diameter portion 270*a* and an upper increased diameter ball-seating portion 270*b*. Additionally, portion 270*b* overlaps with fuel pump discharge bore 272. Bores 270 and 272 are both surrounded by annular O-ring seating groove 274. Coolant transfer bore 276 is surrounded by annular O-ring groove 278. Filtered engine fuel discharge outlet 280 extends through plate 208, and threadably receives upper end portion 282 of engine fuel outlet depth extension tube 284. Outlet 280 is surrounded by annular O-ring groove 286. Threaded gauge port 288 extends through plate 208 from top to bottom. Fuel outlet side gas discharge bore 290 including interior bore 290*a* and ball-seating shoulder region 290*b* is surrounded by annular O-ring groove 292. Fuel inlet side gas discharge bore 294 having interior bore section 294*a* and a greater diameter ball-seating portion 294*b* is surround by annular O-ring groove 296.

Bottom surface 224 (FIG. 11) incorporates ovaloid slot 300 partially overlapping with recessed water separator sealing surface 302, which is concentrically aligned with reduced diameter threaded water separator nipple-receiving bore 304. Threaded filter element-receiving bore 306 extends approximately half way into plate 208, and is concentrically aligned with filter depth extension tube 284 which presents filter discharge end 282. Fuel inlet bore 310 extends partially through plate 208 and has a greater diameter than gauge port 288. Bores 306 and 310 are surrounded by an annular square rubber O-ring groove 312.

Figure 10:
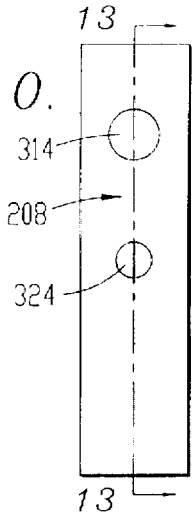
FIG. 10 is an end view depicting flow passageways that are visible on the right hand side of FIG. 9.
Figure 9:
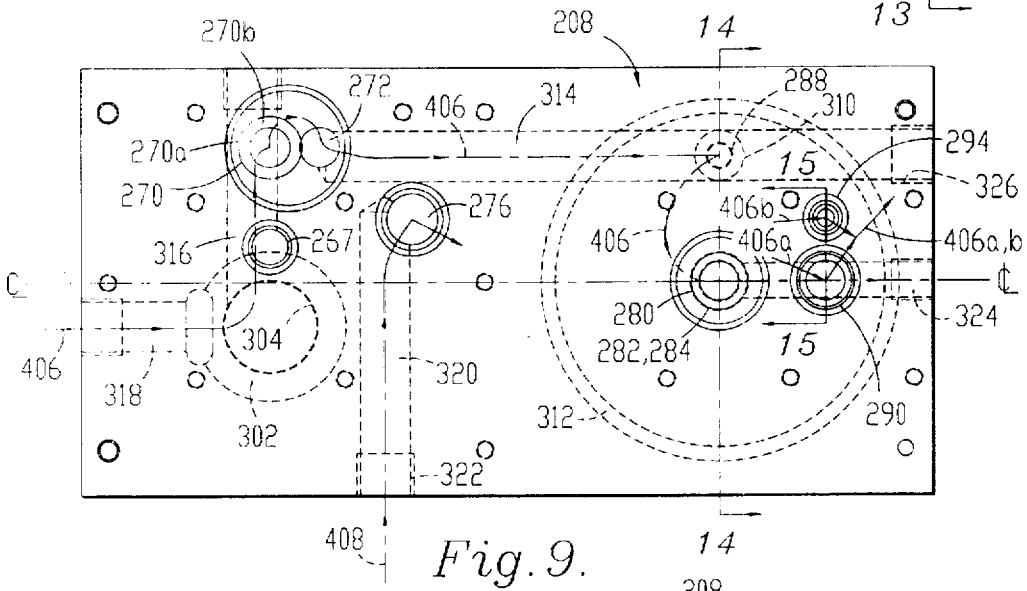
FIG. 9 is a top plan view taken from the rear perspective of a main plate of the filter mounting body depicting the flow passageways therethrough which interconnect openings for mounting a water separator and an air filtration unit.
Figure 13:
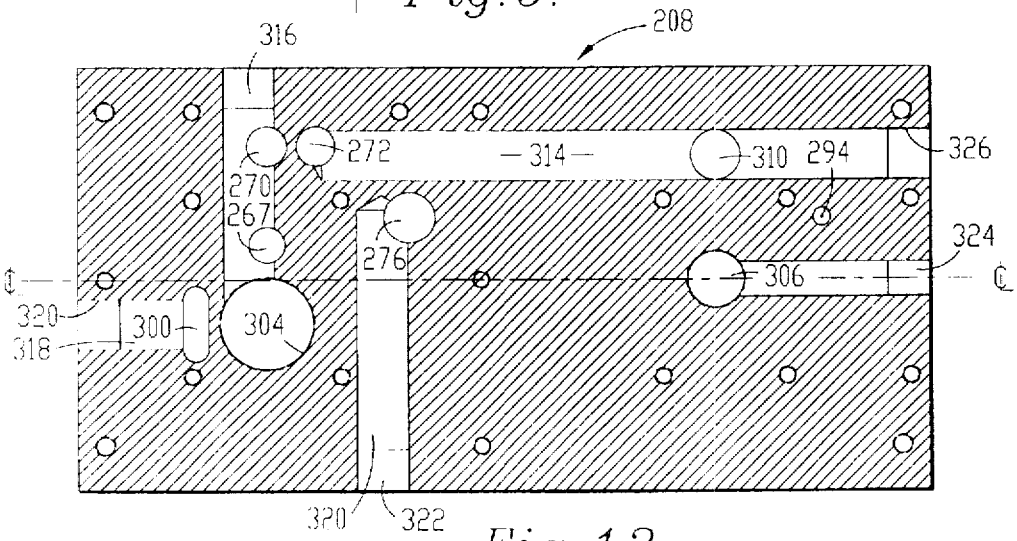
FIG. 13 is a sectional view taken along line 13'—13' of FIG. 10, and depicting a bottom half portion of the main plate.

FIGS. 9, 10, and 13 depict various internal bores within plate 208, i.e., bores 314, 316, 318, 322, and 320, which interconnect a number of the features recited in the above paragraphs. Specifically, horizontally-extending pump tube-to-air separator transfer bore 314 communicates pump discharge bore 272 with filter inlet bore 310 and gauge port 288. Pump intake bore 316 communicates pump inlet bore 267 with pump bypass bore 270 and nipple receiving bore 304. Fuel inlet bore 318 communicates fuel inlet bore 320 and ovaloid slot 300. Coolant intake bore 320 communicates coolant inlet 322 with coolant transfer bore 276. Fuel filter inlet side gas discharge bore 324 communicates filter nipple bore 306 with outlet side gas discharge bore 290. Note that the ends of the respective bores 314–324 are threaded as, for example, at threaded area 326 for receiving a corresponding threaded member (not depicted in FIGS. 9 and 13).

Figure 15:
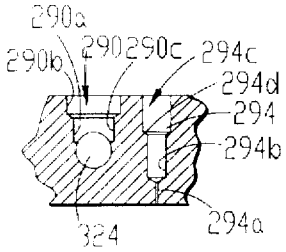
FIG. 15 is a broken sectional view taken across line 15'—15' of FIG. 9 and depicting interior port construction of the main plate.
Figure 14:
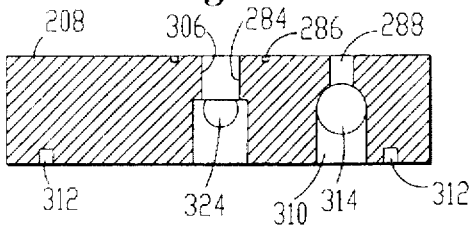
FIG. 14 is a sectional end view taken along line 14'—14' of FIG. 9, depicting a cut line taken across a diameter of a filter mounting area.

FIG. 15 depicts bores 294 and 290 in greater detail. Bore 290 includes a ball-seating tapered section bore 290*c* intermediate bore sections 290*a* and 290*b*. Bore 294 includes section 294*a*, which forms a fuel filter inlet side gas discharge port from bottom surface 298 of plate 208. Section 294*b* communicates section 294*a* with an increased diameter section 294*c* having a ball-seating tapered section 294*d*.

Figure 16:
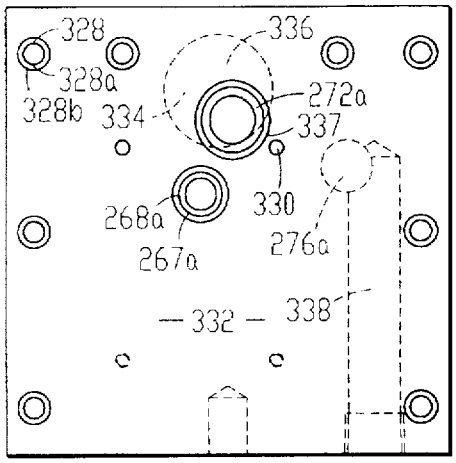
FIG. 16 is a top plan view of a second plate adapted to overlay the main plate of the filter mounting body to furnish extension for passageways within the main plate.
Figure 17:
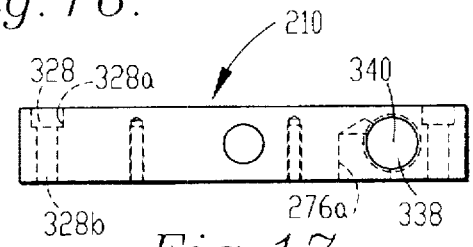
FIG. 17 is a front elevational view of the second plate.

FIGS. 16 and 17 depict water separator plate 210. Plate 210 includes eight openings, such as opening 328 having an uppermost countersunk portion 328*a*, and a narrowed diameter section 328*b* for receiving corresponding threaded members (not depicted in FIGS. 16 and 17) for coupling plate 210 with plate 208. Similarly, plate 210 incorporates four central threaded bolt-receiving cavities, e.g., cavity 330. These openings 328 and cavities 330 are mutually aligned with corresponding threaded openings 234–240 and threaded cavities 244–254, e.g., cavity 330 aligns with cavity 236, and cavity 328 aligns with cavity 232 as depicted in FIG. 6. Uppermost face 332 of plate 210 has fuel pump inlet bore 267*a*, which is vertically aligned with bore 268 in plate 208 (see FIG. 12). Fuel pump discharge bore 272*a* is aligned to communicate with both bores 270 and 272 in plate 208 through underlying partial common bore 334 in plate 210. Bore 334 communicates bores 270 and 272, and provides an underlying-seating plane 336. O-ring groove 337 surrounds bore 272*a*. Plate 210 includes a coolant discharge bore 338 communicating underlying coolant transfer bore 276*a* with threaded coolant discharge opening 340.

FIGS. 18–21 depict air separator area plate 212. Plate 210 includes six openings, e.g., opening 342 having countersunk area 342*a* and interior bore 342*b*, for receiving corresponding threaded members coupling plate 210 with plate 208. These openings are aligned with corresponding cavities 258–266 within plate 208. Top face 344 provides a threaded fuel tank return line bore 346 extending partially through plate 210. Lower face 348 contains inlet side gas discharge bore 294*e*, which is mutually aligned with bore 294 of plate 208 and communicates with bore 346. Face 348 also includes outlet side gas discharge bore 290*d*, which is mutually aligned with bore 290 in plate 208 and communicates with return line bore 346. Engine fuel discharge bore 280*a* is vertically aligned with corresponding bore 280 in plate 208. Horizontally extending engine fuel discharge bore 350 communicates bore 280*a* with threaded fuel discharge outlet 354.

Turning now to FIG. 6, it will be seen from the exploded assembly that O-rings 356, 358, 360, 362, 364, 366, 368, and 370 are each received within corresponding O-ring grooves 292, 296, 286, 278, 268, 274, 268*a*, and 337 for sealing of metal to metal areas of contact between plates 208, 210, and 212. Additionally, flow check balls 372, 374, 376 and 378 are received within corresponding bores 290, 280, 294, and 270, which provide seating elements for the respective balls. Check balls 374 and 380 are biased by respective corresponding compressive coil springs 380 and 381 which press the balls downwardly towards plate 208 by pushing against the overlying plates 210 and 212. The spring and ball assemblies, i.e., 378 and 380, 374 and 381, operate as check valves to allow one way flow through their corresponding apertures and against the bias of the springs. Spring 381 may be selected to have a bias for placing a specific back pressure on flow through filtered fuel discharge port 280.

Plate 210 is coupled with plate 208 by the provision of six threaded members, e.g., member 382 having alien head 382*a* and threaded body 382*b* which is received within opening 328 of plate 210 and threads into cavity 232 of plate 208. Plate 212 is coupled with plate 208 by six threaded members identical to member 382, e.g., member 384 which is received within opening 342 and is threadably received within cavity 248. Pump 214 is attached using a two alien bolts, e.g., bolt 386 passing through apertures 238 and 330 to be threadably received within pump 214. Four alien bolts, e.g., bolt 388 which is received within openings 232 and 222, and bolt 388*a* connect the corners of plate 208 with the respective wings 202 and 204. Apertures 390 and 392 receive corresponding bolts, e.g., bolt 396, for retaining plate 398, which may contain technical information such as the manufacturers model number, compatible filter types, and flow capacities.

Brass plugs 400, 402 and 404 seal their corresponding bores 314, 324, and 326, at positions where threaded pressure gauges or other connective equipment may be installed. Plugs 400–404 are needed to seal their respective bores because the external bore openings are produced by the preferred machining process, which drills out these bores.

Figure 8:
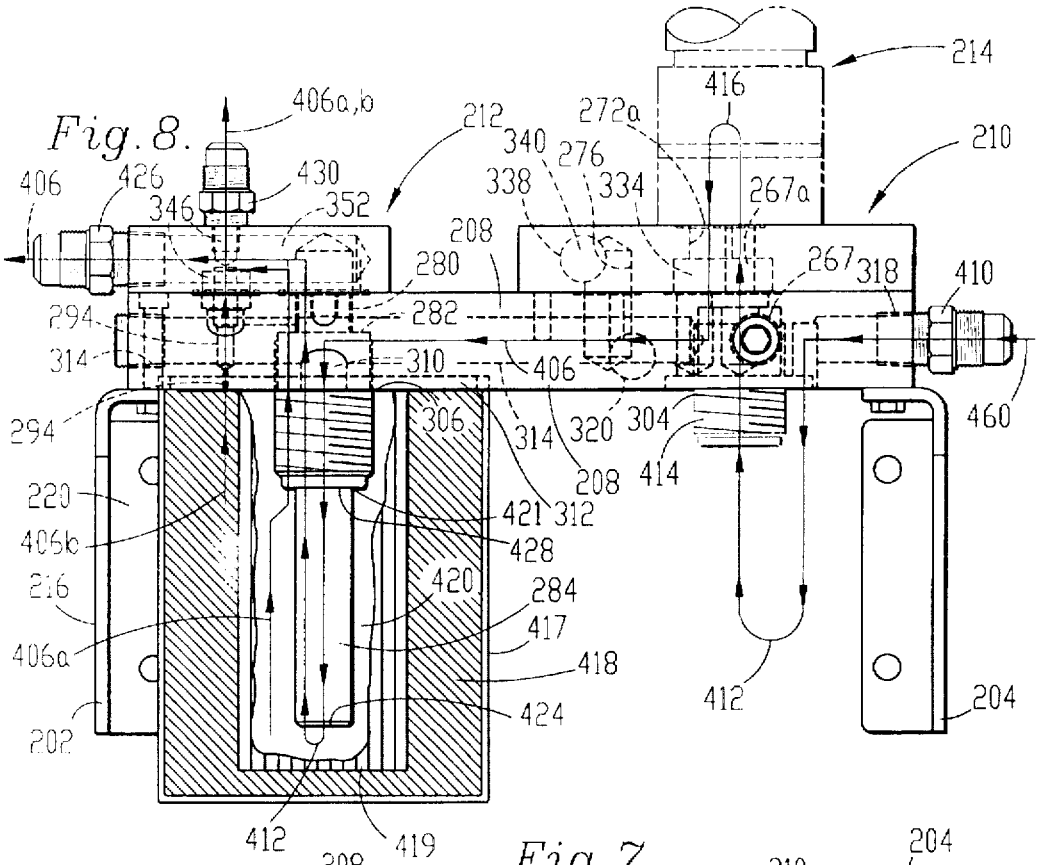
FIG. 8 is a front elevational view thereof depicting the flow passageways.
Figure 7:
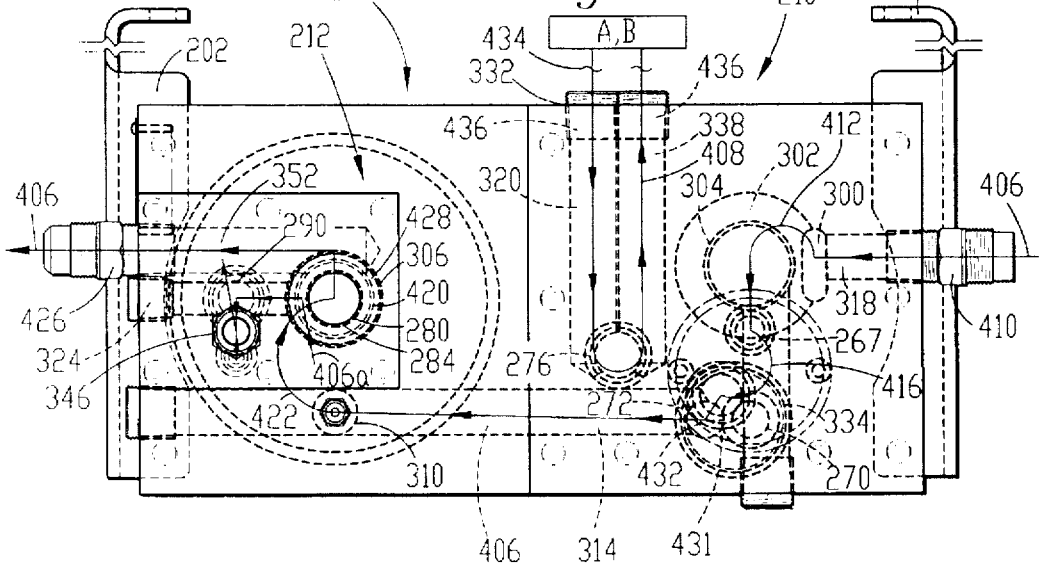
FIG. 7 is a top plan view thereof depicting a plurality of flow passageways within the mounting body.

FIGS. 7 and 8 depict assembled body 206 in greater detail including reference to the respective sequential components of fuel passageway 406, air and fuel return passageways 406*a* and 406*b*, as well as coolant passageway 408. Note that the check valve assemblies, e.g. spring 380 and ball 378 are not depicted by these figures, in order to avoid excessive hidden detail.

Fuel passageway 406 enters main plate 208 through threaded brass fuel inlet coupling 410 (communicating with a diesel fuel tank), which is received within inlet bore 318, and proceeds through bore 318 to descending ovaloid separator inlet slot 300 into a lowermost water separation unit (not depicted in FIGS. 7 and 8, but identical to water separator 16 of FIG. 1). Curved U-shaped passageway portion 412 schematically represents a path for separation of water from the fuel stream within separator 16 which is threadably received upon water separator nipple 414. Nipple 414 has an upper portion that is threadably received within nipple-receiving bore 304.

After water separation, passageway 406 rises through threaded water separator nipple 414, through fuel pump inlet bores 267 and 267*a*, and into fuel pump 214 where it receives a pressure boost. Curved passageway portion 416 schematically represents the interior of pump 214, which discharges through pump discharge bore 272*a*, into common bore 334, and into plate 208 through bore 272. Passageway 406 subsequently travels horizontally through elongated bore 314 and downwardly through fuel filter assembly inlet bore 310 and into cylindrical air separator filter canister 417.

Cannister 417 is commercially available as a single-piece screw-on fuel filter that threadably mounts upon nipple 421 to seat against a rubber square O-ring within groove 312. These types of filters and cannisters are manufactured, for example, by Central Illinois Manufacturing of Bement, Ill.

Curved passageway portion 422 of passageway 406 schematically represents a path extending from inlet bore 310, into the inlet side annular area 418 between canister 417 and the outside of filtration element 419, through the pore openings of filtration element 419 into a clean side or discharge side 420 of element 417, and into fuel exit port 424 of fuel outlet depth extension tube 284 (see FIG. 8). Nipple 421 has an upper portion that is threadably received within filter nipple bore 306.

Tube 284 discharges through its upper end 282 into engine fuel outlet bore 280, and, thereafter, passageway 406 then travels horizontally through fuel discharge bore 352, and into brass engine fuel outlet coupling 426, which is attached to a diesel injector pump supply line.

Passageway 406*a* schematically represents a passageway for air entrained fuel to exit canister 417 from the fuel outlet side 420 of filtration element 419. Passageway 406*a* begins in the outlet side annular area 420 between depth extension tube 284 and element 419. Passageway 406*a* rises circumferentially along the clean side 420 of filtration element 419, and through an annular outlet side gas discharge port 428 lying between the interior of filtration element nipple 421 and the exterior of depth extension tube 284. Port 428 communicates with horizontal outlet side discharge bore 324 (FIG. 7) and vertical discharge bore 290, which feeds common tank return bore 346.

Passageway 406*b* begins on the annular inlet side 418 of filter element 419, and rises along the exterior thereof through inlet side gas discharge port 294*c*, through bore 294, and into common tank return bore 346.

Passageways 406*a* and 406*b* merge within common tank return bore 346 to form common passageway 406*a,b*, which rises to meet brass tank return line coupling 430, which is received within bore 346. Coupling 430 is most preferably connected to a diesel tank return line.

FIGS. 6 and 7 depict a fuel pump bypass 431 including overlapping fuel pump bypass bore 270 and fuel pump discharge bore 272, which communicate through overlying bore 272*a*, as well as gap 432. Spring 380 provides sufficient bias to seat check ball 378 against ball-seating area 270*b* for sealing against fuel flow from pump 214 through horizontal pump inlet bore 316. This ball-seating bias is normally assisted by the pressure imparted to the fuel passing through pump 214; however, in the event that pump 214 fails, spring 380 permits reduced pressure from the engine side fuel demand to unseat ball 378 for bypassing pump 214 by flowing fuel directly from bore 316.

FIGS. 7 and 8 depict coolant passageway 408, which begins at a threaded coolant inlet 322 feeding coolant inlet bore 320 within plate 208. Inlet 322 may optionally be coupled with various conventional exterior assemblies (where options A or B are schematically depicted as having supply line 434) to provide three different thermal operating options: (A) with an engine coolant supply line originating at an engine block for winter driving conditions that may gel diesel fuel to allow heat transfer across bores 320 and 340, and throughout assembly 200; (B) with an air conditioner low pressure line (or a conventional blower-type of air cooling system cooling system) for cooling assembly 200 in conditions of excessively high operational temperature that might tend to vaporize the relatively volatile fractions of diesel fuel; or (C) as depicted with brass bull plugs 436 and 436a sealing bores 320 and 340. Bore 320 transfers the thermal medium along passageway 408 through coolant transfer bore 276 and into coolant discharge bore 338 within plate 210. As before, discharge bore 338 may be operably connected as one of options A, B, or C.

Fuel pump 214 is a conventional electronically powered gear rotor-type fuel pump which is completely conventional, and may be selected for required volume and pressure capacities from any number of commercial manufacturers.

In operation, filter assembly 200 processes a stream of fuel received from a diesel tank (not depicted) wherein the fuel stream contains a fuel portion, an air portion, and a water portion. The elements along passageway 406 sequentially de-water the fuel, with the water being retained in separator 16, actuate the remaining fuel stream through pump 214, and deaerate the actuated fuel within canister 417.

While the engine is not running, electric pump 214 may be operated to circulate and condition the fuel, with a particular emphasis upon de-watering the fuel or purging canister 417 of air after a filter change. In the case of a filter change, check ball 372 prevents diesel backflow from exiting the injector pump supply line connected to coupling 426.

Pressurized fuel delivery supply system 200, when it is used to supply pressurized fuel to the newer electronically controlled injector engines, must provide sufficient quantities of fuel (about 70 to 95 gallons per hour) for purposes of cooling the injectors in addition to meeting engine fuel consumption demands. As compared to conventional low-flow systems, these relatively high fuel supply volumes may initiate turbulent fuel flow regimes within assembly 200. These flow characteristics enhance the effect of viscous forces that can serve to force entrained air within the fuel across filtration element 419. This air will eventually be flashed to occupy a larger volume (for easier removal) as pressure drops across filter element 419 for removal through port 428.

Pump 214 has a sufficient volumetric output to exceed engine demand for fuel through tube 284. This excess output creates a positive flow of fuel along pathways 406*a* and 406*b*, which serves to sweep air bubbles through the corresponding ports 294*c* and 428. Filtration element 419 serves to dislodge the larger bubbles from the fuel, after which the bubbles are swept along the exterior inlet side 418 of element 419 for discharge through port 294 along passageway 406*b*.

In more detail, fuel deaeration occurs within canister 417 along passageways 406*a* and 406*b*. With regard to passageway 406*a*, the filtration element 419 preferably has substantially no pore openings passing through from the inlet side 418 to the outlet side 420 having a diameter greater than about 25 microns. More preferably, these pore openings are less than about 20 microns, and the openings are most preferably less than about 15 microns. Openings less than about 8 microns may still be used, but are not preferred due to a corresponding significant pressure drop that may serve to flash-vaporize the more volatile fuel components. Nevertheless, filters having a smaller pore size may be used, if care is taken to increase the surface area of element 419 so as not to incur a severe pressure loss (e.g., greater than about 20 pounds) for a given volume of flow.

Depth extension tube 284 preferably extends beneath the center or centroid of filtration element 419, below the level of fuel in canister 417, and most preferably extends to a position proximal to the bottom of filtration element 419, in order to allow entrained air bubbles, which have been slightly expanded by flashing across pressure-reducing element 419, to rise with positive fuel flow along the exterior of tube 284 towards annulus 428 for a subsequent return to the fuel tank along path 406*a*. Orifice 424, by drawing the relatively deeper fuel, receives a substantially air-free engine fuel supply.

With regard to passageway 406*b*, the inlet side 418 of filtration element 419 will dislodge a portion of the larger entrained air bubbles from the fuel stream, and these are free to rise in the annular area between canister 417 and element 419 towards port 294*c* for a subsequent return to the fuel tank.

High-flow electronic injection engine fuel delivery systems are particularly sensitive to the presence of vapors derived from flashing the fuel across a filtration member or other pressure-reducing flow node or constriction. In fact, the flashing of volatile fuel or entrained air fractions can cause serious operational difficulties in the engine due to the timing of injector discharge. The fuel vaporization problem can be particularly acute in instances where the fuel is flashed across a dirty or partially plugged filtration element. Substantially all of any such vapors appearing on the clean side of element 419 will exit through annular discharge port 428 along passageway 406*a*.

Port 294 a has a greatly reduced surface area or areal extent with respect to the combined areal extent of annulus 428 and filter discharge port or orifice 422. This reduced area serves to force the majority of fuel through port 422 and annulus 428 by reducing the area available to the flowing fuel stream, thereby providing a choke. Of course, gas viscosities are significantly lower than are liquid viscosities, and a relatively large volume of air may still flow across port 294. System back pressure may be adjusted by selecting spring 381 to have a bias for limiting flow through tube 284 via check ball 381. Additionally, the volume of fuel flow across filtration element 419 may be adjusted by altering the ratio of the areal extent of annulus 428 to the areal extent of port 494*c*. This ratio preferably ranges between about 1500:1 and 40:1, more preferably ranges between about 800:1 and 80:1, and even more preferably ranges between about 100:1 and 250:1.

Passageway 408 may be connected as described in options in A, B, or C to provide thermal transfer as needed for purposes of preventing the diesel from gelling (in low operational temperatures) or vaporizing to potentially cause vapor lock (in high operational temperatures).

Some conditions, such as pump stoppages, elevational differences, or line breakages, may induce fuel to backflow through assembly 200, thereby introducing undesirable air into assembly 200. Any such backflow is prevented by the action of check balls 372, 374, and 376, which provide for one-way flow through bores 280, 290, and 294. These check valves also function as regulators to provide back-pressure against the direction of flow, due to the strength of the springs which the respective balls contact. Additionally, brass return line coupling 430 may be provided with a check valve, such as a flapper valve, to prevent backflow of diesel from the fuel tank through filtration element 419.

EXAMPLE 1

Performance Increases Due to the Air Removal Assembly

Assembly 200 was installed on a plurality of tractor-trailer trucks for testing to determine whether the removal of entrained air from diesel fuel could result in substantial performance increases.

A first truck was retrofitted with assembly 200. The engine was a Detroit Diesel 425 Series 60 engine, and this is designed to place about 380 horsepower on the ground after drive train reductions. After the retrofit with assembly 200, this engine delivered 440 horsepower to a dynamometer after drive train reductions.

A second truck was retrofitted with assembly 200. The engine was a Detroit Diesel 440 Series 60. Prior to the retrofit with assembly 200, during conditions of normal use, the operator observed a fuel economy of 5.4 miles per gallon (mpg"). After the retrofit operation, the operator observed a 0.8 mpg increase in fuel economy to 6.2 mpg, i.e., an increase of about 15%.

A third truck having a Detroit Diesel 430 Series 60 engine was retrofitted with assembly 200. Operation under conditions of normal use yielded an increase from 6.4 mpg to 6.8 mpg or about 6%.

Those of ordinary skill in the art will understand that various modifications may be made to the preferred embodiments, as described hereinabove, without departing from the scope of the invention. By way of example, plate 208 may be bifurcated into separate halves comprising the water separation portion beneath plate 210 and the air separation portion beneath plate 212, and these halves may be mounted in respective locations after being operably coupled by extending bore 248. Furthermore, while plates 208, 210, and 212 are preferred due to the high strength and the reduction in space owing to this particular construction, various plumbing items may be substituted to provide operable linkages communicating the essential openings.

As an additional matter, assembly 200 is preferably utilized as a component in a diesel fuel supply system;

however, assembly 200 (and particularly one without a water separation unit) may also be operably connected with appropriate supply and return lines for the removal or air from various liquids in applications at least including the removal of air from automatic transmission fluids, automotive fueling stations, or even from machinery lubricating oils where foaming may be problematic.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the liberal scope of the invention as set out in the following claims.

I claim:

1. A filtration assembly for separating entrained air from a flowing fluid that contains a liquid having an entrained gas portion, comprising:

a filtration unit including a container having marginal wall structure defining an interior chamber, and a filtration element dividing said chamber into an inlet side and an outlet side; and a mounting body having an inlet in fluidic communication with said inlet side and an outlet in fluidic communication with said outlet side, and means for coupling said inlet and said outlet with said filtration unit to cause portions of said fluid to pass between said inlet and said outlet across said filtration element, said body having a first gas exit port in fluidic communication with said inlet side and a second gas exit port in fluidic communication with said outlet side.

2. In a filtration assembly of the type including a filtration unit having a fluid inlet side and a fluid outlet side, and a flange for mounting said unit, the improvement comprising:

a flange having a plurality of passageways including at least a fluid inlet side passageway, a fluid outlet side passageway, an inlet side gas outlet passageway, an outlet side gas passageway and means for retaining said filtration unit in operable relationship with respect to said passageways;

a first check valve operably coupled with said flange to prevent reversal of flow through said inlet side gas passageway; and a second check valve operably coupled with said flange to prevent reversal of flow through said outlet side gas passageway.

3. A filtration assembly for separating entrained air and water from a flowing fluid that contains a fuel having an entrained air portion and an entrained water portion, comprising:

a water separator having a fluid intake opening and a fluid discharge opening;

means in fluidic communication with said discharge opening for receiving fluid from said separator at a first pressure, and for issuing the fluid at a second pressure greater than said first pressure;

a filtration unit in fluidic communication with said issuing means to receive pressurized fluid therefrom, said unit including a container having marginal wall structure defining an interior chamber and a filtration element dividing said chamber into an inlet side and an outlet side; and a mounting body having an inlet in fluidic communication with said inlet side and an outlet in fluidic communication with said outlet side, and means for coupling said inlet and said outlet with said filtration unit to cause portions of said fluid to pass between said inlet and said outlet across said filtration element, said body having a first gas exit port in fluidic communication with said inlet side and a second gas exit port in fluidic communication with said outlet side.

4. The assembly as set forth in claim 1, said first gas exit port presenting a first cross-sectional area, said outlet and said second gas exit port presenting a combined second cross-sectional area, a ratio of said second crossectional area to said first crossectional area ranging between about 1500:1 and 40:1.

5. The assembly as set forth in claim 4, said ratio ranging between about 100:1 and 250:1.

6. The assembly as set forth in claim 1, said outlet including a vertically oriented depth extension tube.

7. The assembly as set forth in claim 6, said depth extension tube having an intake orifice positioned beneath a centroid of said filtration element.

8. The assembly as set forth in claim 6, said second gas exit port including an annular space concentric with a portion of said depth extension tube.

9. The assembly as set forth in claim 1, further including a pump and means for operably coupling said pump with one of said inlet and said outlet for transfer of fuel between said pump and said one of said inlet and said outlet.

10. The assembly as set forth in claim 8, said coupling means including a passageway communicating said inlet with a discharge opening from said pump.

11. The assembly as set forth in claim 10, said pump having an intake opening and a capacity for imparting a pressure increase of at least about 5 psi to said liquid between said intake opening and said discharge opening.

12. The assembly as set forth in claim 1, said filter having substantially no through openings from said inlet side to said outlet side of a mean pore diameter greater than about 20 microns.

13. The assembly as set forth in claim 1, said mounting body including means for circulating a compound to effect thermal conditioning of said fluid.

14. The assembly as set forth in claim 13, said circulating means including passageways operably connected with a supply for said compound.

15. The assembly as set forth in claim 3, said first gas exit port presenting a first cross-sectional area, said outlet and said second gas exit port presenting a combined second cross-sectional area, a ratio of said second area to said first area ranging between about 1500:1 and 40:1.

16. The assembly as set forth in claim 3, said outlet including a vertically oriented depth extension tube having an intake orifice positioned beneath a centroid of said filtration element.

17. The assembly as set forth in claim 16, said second gas exit port including an annular space concentric with said depth extension tube.

18. The assembly as set forth in claim 17, said mounting body having circulation passages providing means for circulating a compound to effect thermal conditioning of said fluid.

19. The assembly as set forth in claim 18, said circulating means including internal surface area for conducting heat between said compound and said passages.

20. A fuel filtration assembly for separating entrained air and water from a flowing fluid that contains a fuel having an entrained air portion and an entrained water portion, and supplying purified fuel to an engine, comprising:

a water separator having a fluid intake opening and a fluid discharge opening;

a fuel pump in fluidic communication with said discharge opening to receive fluid from said separator at a first pressure, and having a capacity sufficient to issue the fluid at a second pressure greater than said first pressure;

a filtration unit in fluidic communication with said issuing means to receive pressurized fluid therefrom, said unit including a container having marginal wall structure defining an interior chamber and a filtration element dividing said chamber into an inlet side and an outlet side; and a mounting body having an inlet in fluidic communication with said inlet side and an outlet in fluidic communication with said outlet side, and means for coupling said inlet and said outlet with said filtration unit to cause portions of said fluid to pass between said inlet and said outlet across said filtration element, said body having a first gas exit port in fluidic communication with said inlet side and a second gas exit port in fluidic communication with said outlet side.

an engine in fluidic communication with said outlet to receive liquid therefrom.

* * * * *